US005885098A

United States Patent [19]

Witkowski

[11] Patent Number: 5,885,098

[45] Date of Patent: Mar. 23, 1999

[54] CORD SET RECEPTACLE

[75] Inventor: Ireneusz Witkowski, Winnipeg, Canada

[73] Assignee: Phillips & Temro Industries Inc., Eden Prairie, Minn.

[21] Appl. No.: 928,296

[22] Filed: Sep. 12, 1997

[51] Int. Cl.[6] ..... H01R 13/62

[52] U.S. Cl. ..... 439/369; 439/350; 439/136; 439/533

[58] Field of Search ..... 439/367–369, 439/135, 136, 34, 350–357, 533, 540.1

[56] References Cited

U.S. PATENT DOCUMENTS

| | | | |
|---|---|---|---|
| 4,917,625 | 4/1990 | Haile | 439/369 X |
| 4,940,423 | 7/1990 | Aihara et al. | 439/369 |
| 5,382,179 | 1/1995 | Noschese | 439/369 X |
| 5,588,853 | 12/1996 | Anthony | 439/136 |

FOREIGN PATENT DOCUMENTS

| | | | |
|---|---|---|---|
| 3715358 | 11/1988 | Germany | 439/136 |

*Primary Examiner*—Khiem Nguyen
*Attorney, Agent, or Firm*—Harness, Dickey & Pierce, P.L.C.

[57] ABSTRACT

A cord set for electrically connecting an electrically powered device to a power source. The cord set includes a plug, a receptacle defining an axis and an axial passage extending through the receptacle to accommodate the plug, and coupling means extending axially from the receptacle for coupling the plug to the receptacle. The present invention is also directed to a cord set receptacle that defines an axis and an axial passage extending through the receptacle to accommodate a plug and coupling means extending axially from the receptacle for coupling the plug to the receptacle.

18 Claims, 2 Drawing Sheets

CORD SET RECEPTACLE

BACKGROUND OF THE INVENTION

1. Technical Field

The present invention relates generally to electrically powered accessories for motor vehicles and, more particularly, to a cord set for such electrical powered accessories.

2. Discussion

Various electrically powered devices are designed for use with vehicles including automobiles, light-duty trucks, and heavy-duty vehicles. These devices, including cold weather starting devices such as radiant heaters, engine block heaters, fluid heaters, battery warmers, and the like, are generally fixed to the automobile body and operationally connected to an appropriate component of the vehicle engine. The operation of the devices generally occurs upon connection to a power source external to the vehicle. Accordingly, a factor in the sales and use of these devices is the simplicity with which the device can be electrically connected to the power source. To address this ease of use concern, cord sets have been developed that include a receptacle connected to the vehicle body for mounting an electrical cord that is connected to the electrically powered device. The power cords of the cord sets terminate at a male or female plug that is coupled to the receptacle whereupon connection of the male or female plug to an appropriately configured counterpart plug external to the vehicle engine compartment allows selective electrical connection of the device to the power source.

Cord sets for selectively electrically connecting an electrically powered automobile accessory to a power source are available for use with heavy-duty vehicles and selected automotive applications. Specifically, the assignee of the present invention and others have manufactured cord set receptacles that are generally cylindrical in shape and include a cylindrical housing open at one end to accommodate a male plug and normally closed at a second end by a spring biased cover. To securely yet releasably connect the male plug to the housing, the housing is provided with an opening that accommodates a spring biased button on the plug. The spring biased button prevents inadvertent removal of the male plug from the housing and, as noted above, has generally been found to provide a satisfactory cord set receptacle for heavy-duty vehicles.

Despite the satisfactory application of the above-described cylindrical type cord set for use with heavy-duty trucks and certain automotive applications, the same configuration has been found to be unsatisfactory for many uses in the automotive market. Cord sets for the automotive market are subject to extremely tight space constraints that are not satisfied by the cylindrically configured receptacle with the spring biased button. More particularly, the above-described cylindrical cord set requires that the male plug that is inserted within the receptacle have the button and biasing mechanism contained within the plug itself. As a result, the plug must be enlarged to accommodate these additional mechanical features. In view of the tight space constraints for the automotive market, it is desirable that an automotive cord set include a mechanism for intercoupling the receptacle and plug that does not increase the overall size of the receptacle. Prior art cord sets have failed to address this need.

SUMMARY OF THE INVENTION

Accordingly, the present invention relates to a cord set that meets the tight space constraints for use in the automotive market. More particularly, the cord set of the present invention includes a plug, a receptacle defining an axis and an axial passage extending through the receptacle that accommodates the plug, and coupling means extending axially from the receptacle for coupling the plug to the receptacle. Similarly, a cord set receptacle according to the present invention includes a housing defining an axis and an axial passage extending through the housing to accommodate a plug as well as coupling means extending axially from the housing for coupling the plug to the receptacle.

BRIEF DESCRIPTION OF THE DRAWINGS

Other objects and advantages of the invention will become apparent to one skilled in the art upon reading the following specification and subjoined claims and upon reference to the drawings in which:

DETAILED DESCRIPTION

Figure 1:
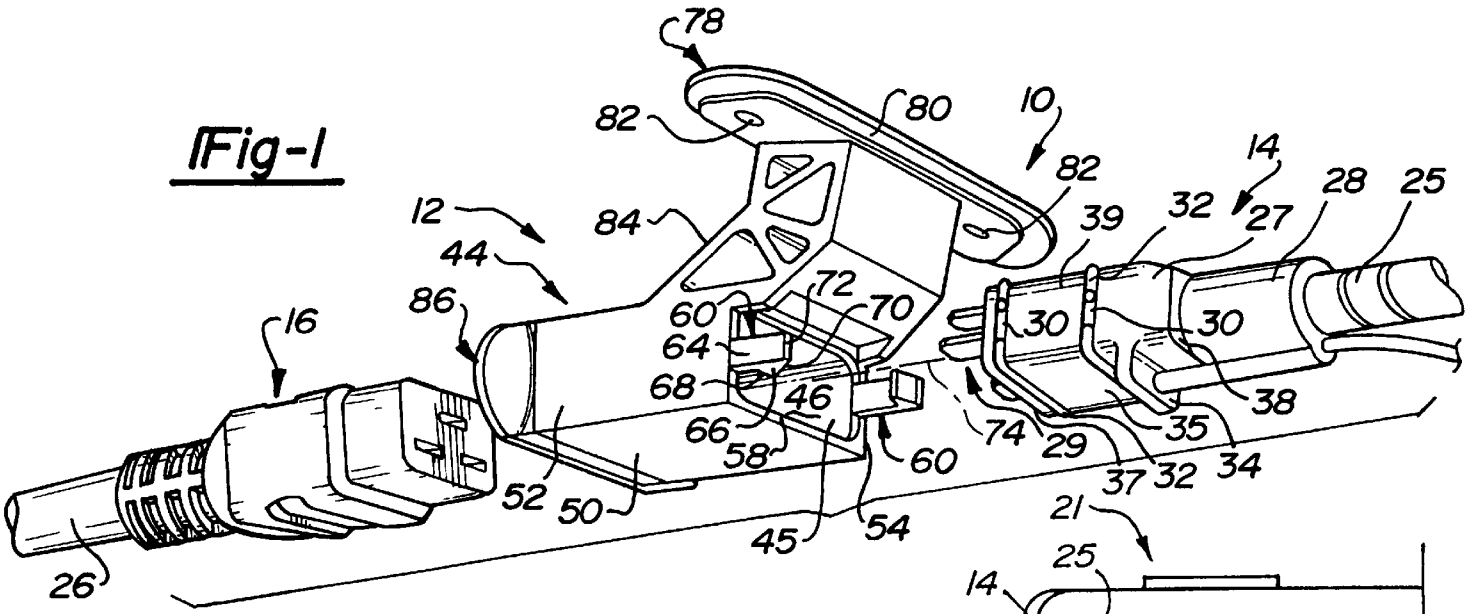
FIG. 1 is a perspective view of a cord set according to the present invention.
Figure 2:
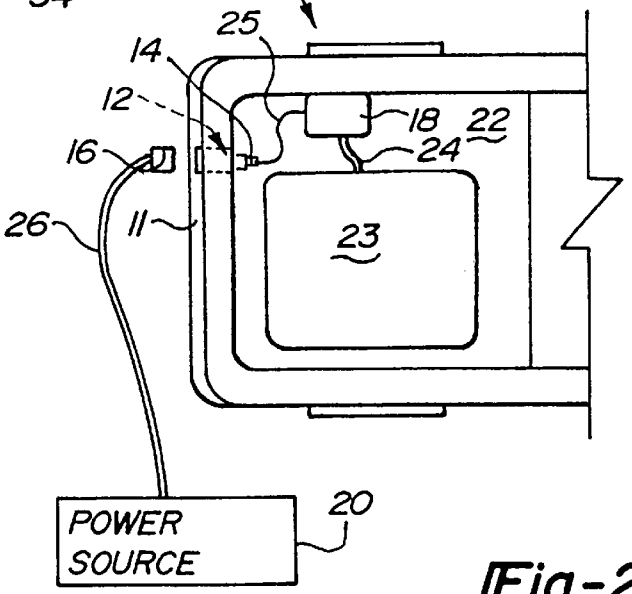
FIG. 2 is a schematic illustration of a cord set according to the present invention for use with an automobile.

The following description of the preferred embodiments of the present invention is merely exemplary in nature and is not intended to limit the scope of the invention as defined by the appended claims. With reference to FIG. 1, the cord set 10 of the present invention is illustrated to include a receptacle or housing 12 and plug 14. The plug 14 is illustrated in FIG. 1 as being a male electrical plug cooperative with a female plug 16 for electrically connecting an electrical automobile accessory 18 to a power source 20 (FIG. 2). It should be appreciated that cord set 10 is preferably configured for use with a commonly available female plug 16 such as IEC 320-C20 plug type. Those skilled in the art will further appreciate that while the preferred embodiment of cord set 10 includes male plug 14, the cord set could include a female plug such as that referenced in the drawings by numeral 16 in lieu of the male plug without departing from the scope of the invention as defined by the appended claims.

As described in greater detail hereinafter, the coupling components of receptacle 12 and male plug 14 provide for removable coupling of these elements in a manner that reduces the overall size of cord set 10 when compared to prior art cord set configurations. This reduction in size allows the cord set to be used in the extremely tight space constraints required for applications in the automotive market.

A specific environment in which the cord set 10 of the present invention is contemplated for use is illustrated in FIG. 2 wherein automobile accessory 18 is mounted to an automobile 21 such as within engine compartment 22 thereof. It should be noted that automobile accessory 18 is intended to be fixed to an appropriate support structure on the automobile body and operationally coupled to an appropriate component of the vehicle engine 23 such as through the use of a heating element or equivalent component generally illustrated by reference numeral 24. In the present invention, a first cord 25 electrically connects plug 14 to the automobile accessory 18. A second cord 26 electrically connects plug 16 to power source 20. By this arrangement, electrical automobile accessory 18 may be selectively electrically connected to power source 20 without requiring direct access to the engine compartment of the vehicle.

As best illustrated in FIG. 1, male plug 14 includes a generally rectangular shaped body 27 integral with a stress relief sleeve 28. The wires within cord 25 extend through stress relief sleeve 28 and are electrically connected in a manner known in the art to a plurality of conducting tabs 29 extending from body 27. A pair of spaced grooves 30 are formed in and about body 27 to provide a seat for seal rings 32. Those skilled in the art will appreciate that seal rings 32 are compressed between body 27 and receptacle 12 when plug 14 is inserted within the receptacle as hereinafter described whereby seal rings 32 provide a weather tight seal between receptacle 12 and plug 14 in a manner generally known in the art.

Figure 3:
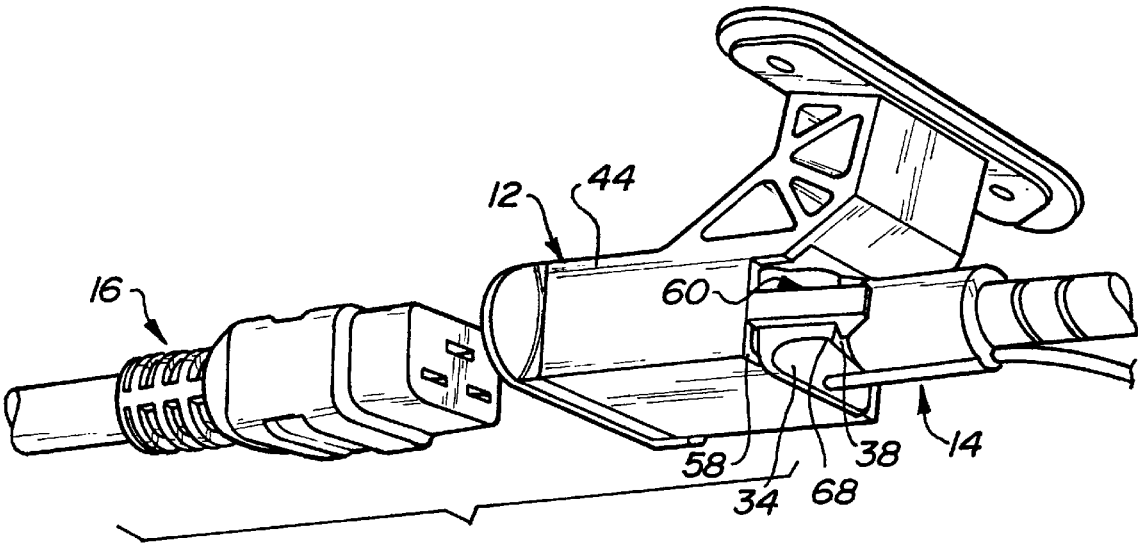
FIG. 3 is a perspective view of the cord set illustrated in FIG. 1 with the male plug inserted into the receptacle.

Rectangular body 27 further includes a stop 34 projecting from a lower surface 35 thereof. As shown in FIG. 3, stop 34 is configured to abut receptacle 12 to limit the distance that plug 14 can be inserted within the housing. Those skilled in the art will appreciate that stop 34 is located a predetermined distance from a front face 37 (FIG. 1) of body 27 to insure proper coupling of plug 14 to receptacle 12 while allowing for the connection of female plug 16. Moreover, a rear face 38 of body 27 acts as a locking surface for engagement with a locking mechanism on receptacle 12 as described below.

Turning now to the structure and configuration of receptacle 12, receptacle 12 includes a sleeve 44 having an inner surface 45 defining a passage 46 that is sized to accommodate plugs 14 and 16. Sleeve 44 defines upper and lower planar surfaces 48 and 50, side surfaces 52 and 54, and front and rear end faces 56 (FIG. 4) and 58, respectively. The above described locking mechanism includes a pair of locking tabs 60 having a trunk 64 integral with and extending rearwardly from rear end face 58 and terminating at a head 66. The head 66 of each locking tab 60 includes an abutment surface 68 intersecting an inclined face 70 that tapers to a terminal face 72. As best illustrated in FIG. 3, when plug 14 is inserted within the passage of the receptacle sleeve 44, stop 34 engages rear end face 58 to limit the distance that the plug may be inserted therewithin. During insertion, inclined faces 70 of locking tabs 60 are urged outwardly away from passage 46 by engagement with the side surfaces 39 of the plug body 27. When plug 14 approaches full insertion within passage 46 of sleeve 44, heads 66 of locking tabs 60 pass beyond locking surface 38 of body 27 whereupon the resilient biasing forces generated by the displacement of locking tabs 60 urge the locking tabs toward one another such that abutment surfaces 68 thereof move into locking engagement with locking surface 38 as illustrated in FIG. 3.

It should be appreciated from this description as well as the appended claims and drawings that the locking tab configuration of the present invention provides a receptacle having a limited height orthogonal to an axis 74 (FIG. 1). More particularly, by using a coupling assembly that extends generally along axis 74, the height 76 and width 77 (FIG. 4) of receptacle 12 may be reduced to the minimum dimensions necessary to accommodate the electrical components of the cord set plugs 14 and 16 or other design criteria unrelated to the locking mechanism. More particularly, with reference to the prior art's use of a spring biased button extending from the plug body, the present invention does not require additional coupling components that extend orthogonal to axis 74 thereby allowing the receptacle to be used in tight space constraints such as in the automotive market.

Figure 4:
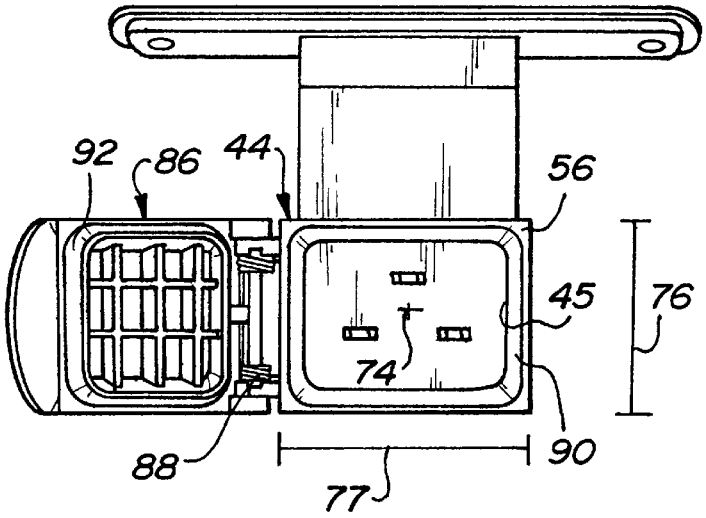
FIG. 4 is a front elevational view of the male plug and receptacle illustrated in FIG. 3.

Returning to the description of receptacle 12 as illustrated in FIGS. 1, 3, and 4, receptacle 12 includes a mounting structure 78 which, in the preferred embodiment, includes a support plate 80 having a pair of apertures 82 for accommodating appropriate fasteners known in the art. Support plate 80 is connected to sleeve 44 via a webbed support arm 84 extending between and integral with plate 80 and upper planar surface 48 of sleeve 44. It is specifically contemplated that the receptacle 12 is positionable in a convenient location relative to the vehicle body such as proximate to the bumper 11 or grill (not shown) thereof as shown in FIG. 2 for selectively electrically connecting female plug 16 to male plug 14. Preferably, one of the front end face 56 and cover 86 is placed flush with or proximate to the grill or bumper of the automobile. Notwithstanding the above description, those skilled in the art will appreciate that a variety of fasteners and mounting structures may be used to secure the receptacle to any appropriate support structure on an automobile or other device without departing from the scope of the invention as defined by the appended claims.

Turning to FIG. 4, cover 86 is pivotably coupled to sleeve 44 in a manner known in the art for movement between a fully open position as illustrated in FIG. 4 and a sealed position as shown in FIG. 1. A spring 88 (FIG. 4) or an equivalent biasing assembly is used to urge cover 86 into the closed position illustrated in FIG. 1.

The specific configuration of cover 86 and sleeve 44 proximate to front end face 56 provides a weather seal therebetween without the use of a gasket or other sealing material. More particularly, a taper 90 extending from front end face 56 to inner surface 45 cooperates with an appropriately configured inclined surface 92 on cover 86 to provide the above-mentioned weather seal. Those skilled in the art will appreciate that the biasing force of spring 88 urges inclined surface 92 into contacting engagement with taper 90 to create a seal therebetween. This weather seal protects conducting tabs 29 of plug 14 from the corrosive effects of environments outside of sleeve 44. Conducting tabs 29 are further isolated from the environment surrounding the sleeve by the above-described seal rings 32.

From the above description, those skilled in the art will appreciate that the cord set of the present invention allows a cord and plug to be releasably coupled to a receptacle that is fixed to a support structure on an automobile or other body. In normal operation, while the plug is releasably coupled to the receptacle, it is preferred to maintain the plug 14 in coupling engagement with the receptacle. To electrically connect the electrically powered device to a power source, a second plug may be disposed within the receptacle in engagement with the first plug. The locking mechanism provided by the receptacle extends along or parallel to the receptacle axis so as to limit the size of the receptacle thereby allowing for its use in bodies having tight space constraints.

Figure 5:
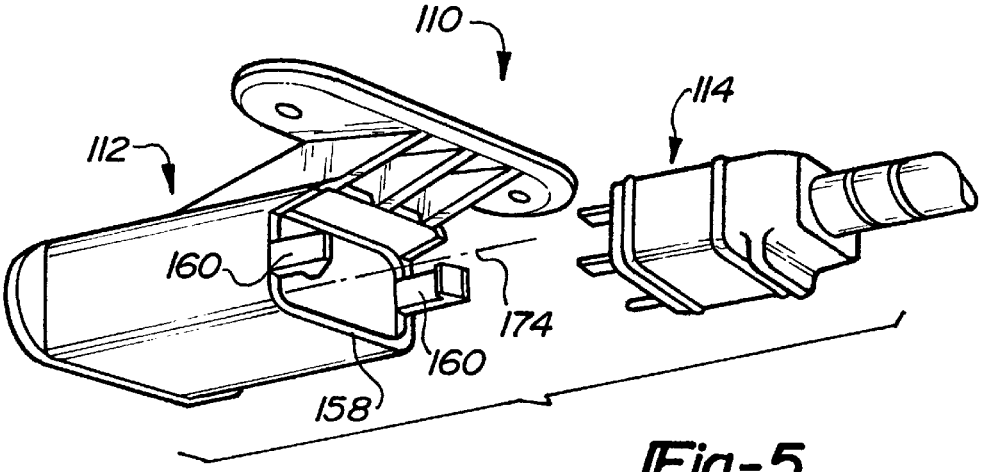
FIG. 5 is an exploded perspective view of an alternative cord set configuration.

Finally, while the cord set illustrated above is designed for use in a 230 volt power supply environment, the present invention is equally applicable for other power supplies. For example, an alternative embodiment of the present invention for use with a 120 volt powered electrical device is shown in FIG. 5. The receptacle 112 is substantially the same in structural and operational features as the receptacle 12 described above. Specifically, the locking tabs 160 of receptacle 112 again extend from a rear end face 158 of receptacle 112 along and/or parallel to receptacle axis 174. It should be appreciated by those skilled in the art that the various electrical requirements of the electrically powered device 18 (FIG. 2) will generally govern the size of plug 114 and therefore the size of receptacle 112.

Various other advantages of the present invention will become apparent to those skilled in the art after having the benefit of studying the foregoing text and the appended drawings, taken in construction with the following claims:

What is claimed is:

1. A cord set comprising:

a receptacle defining an upper surface, an axis and an axial passage extending through said receptacle a plug disposable in said axial passage and having a stop engageable with said receptacle to limit the distance in a first axial direction that said plug is disposable in said axial passage; and separate coupling means extending axially from said receptacle for coupling said plug to said receptacle and limiting movement of said plug within said axial passage in a second axial direction opposite said first axial direction.

2. The cord set of claim 1 wherein said coupling means releasably couples said plug to said receptacle.

3. The cord set of claim 2 wherein said receptacle includes a rear end face communicating with said passage and wherein said coupling means includes a pair of locking tabs extending from said rear end face.

4. The cord set of claim 3 wherein said plug includes a locking face engageable with said locking tabs when said plug is disposed within said passage to couple said plug to said receptacle.

5. The cord set of claim 3 wherein said locking tabs each include a trunk integral with said receptacle and a head integral with said trunk.

6. The cord set of claim 5 wherein said head includes an abutment surface, a terminal surface, and an inclined surface interconnecting said abutment surface and said terminal surface.

7. The cord set of claim 1 wherein said plug includes a bottom surface and said stop extends from said bottom surface, wherein said receptacle includes a rear end face, and wherein said stop abuts said rear end face of said receptacle when said plug is in a fully inserted position relative to said receptacle.

8. The cord set of claim 1 wherein said receptacle further includes a sleeve having an inner surface defining said axial passage, a cover including a tapered seal face pivotably coupled to said sleeve for movement between an open position and a closed position, a front end face, and an inclined seal face extending from said front end face toward said inner surface, and biasing means for urging said cover toward said closed position, said tapered seal face and said inclined seal face being engageable to define a seal between said cover and said sleeve when said cover is in said closed position.

9. The cord set of claim 1 wherein the cross section of said receptacle perpendicular to said axis is generally rectangular in shape.

10. The cord set of claim 1 wherein said stop and said coupling means cooperate to position said plug at a predetermined location within said receptacle.

11. A cord set for electrically connecting an electrical device coupled to a vehicle to a power source external to the vehicle, said cord set receptacle comprising:

a first plug;

a second plug;

a receptacle defining an axis and a passage extending through said receptacle, said passage accommodating said first plug; and coupling means extending axially from said receptacle for coupling one of said first plug and said second plug to said receptacle, said first plug having a stop engageable with said receptacle to limit the distance in a first axial direction that said first plug is disposable in said passage, said coupling means limiting movement of said first plug within said passage in a second axial direction opposite said first axial direction.

12. The cord set of claim 11 wherein said first plug is a male plug.

13. The cord set of claim 11 wherein said receptacle includes a first end face and a second end face, said passage extending from said first end face to said second end face, said coupling means extending axially from said second end face of said receptacle.

14. The cord set of claim 13 wherein said coupling means includes a pair of locking tabs extending from said second end face.

15. The cord set of claim 13 wherein said second plug is insertable within said passage from said first end face and wherein first plug is insertable within said passage from said second end face.

16. The cord set of claim 11 wherein said first plug includes a bottom surface and said stop extends from said bottom surface, wherein said receptacle includes a rear end face, and wherein said stop abuts said rear end face when said first plug is in a fully inserted position relative to said receptacle.

17. A cord set receptacle comprising:

a housing defining an axis and an inner surface defining an axial passage extending through said housing, said passage accommodating a plug, said housing having a front end face and an inclined seal face extending from said front end face toward said inner surface;

a cover pivotably coupled to said housing for movement between an open position and a closed position, said cover including a tapered surface engageable with said inclined seal face when said cover is in a said closed position to create a seal between said cover and said housing;

biasing means for urging said cover toward said closed position; and coupling means extending axially from said housing for coupling the plug to said housing.

18. The cord set receptacle of claim 17 wherein said housing includes a rear end face communicating with said passage and wherein said coupling means includes a pair of locking tabs extending from said rear end face.

* * * * *